United States Patent [19]

Thompson

[11] 4,154,401

[45] May 15, 1979

[54] SPRAY UNIT AND PRESSURIZING ADAPTER THEREFOR

[76] Inventor: William E. Thompson, 29130 Kentucky Rd., Leisure City, Fla. 33033

[21] Appl. No.: 853,043

[22] Filed: Nov. 21, 1977

[51] Int. Cl.[2] ..... B05B 9/04

[52] U.S. Cl. ..... 239/373; 222/402

[58] Field of Search ..... 239/152, 154, 309, 311, 239/373; 222/192, 397, 399, 401, 402

[56] References Cited

U.S. PATENT DOCUMENTS

| | | | |
|---|---|---|---|
| 211,234 | 1/1879 | Giffard | 239/373 X |
| 2,028,265 | 1/1936 | Winner | 222/397 |
| 2,211,823 | 8/1940 | Jepson | 239/373 X |
| 2,596,414 | 5/1952 | Knapp | 239/373 X |
| 2,645,381 | 7/1953 | Lattman | 222/401 X |
| 2,889,997 | 6/1959 | Gallo | 222/399 X |
| 3,147,923 | 9/1964 | Smalley | 239/373 |

FOREIGN PATENT DOCUMENTS

| | | | |
|---|---|---|---|
| 512816 | 9/1939 | United Kingdom | 239/373 |

*Primary Examiner*—Johnny D. Cherry
*Attorney, Agent, or Firm*—Oltman and Flynn

[57] ABSTRACT

A pesticide spraying unit is pressurized with compressed air through an air filler one way check valve of the type having a non-puncturing depressible stem. The check valve is preferably affixed to an adapter which can be inserted between the cap and tank of the spraying unit. A pressure relief valve and a pressure gauge may also be affixed to the adapter. Optionally, a puncturing type of gas cartridge charging device may be affixed to the adapter. The spray unit includes a manual pump, and the air filler check valve and the gas cartridge charging device provide alternatives for charging the tank of the spray unit with compressed gas.

15 Claims, 7 Drawing Figures

SPRAY UNIT AND PRESSURIZING ADAPTER THEREFOR

BACKGROUND OF THE INVENTION

Charging of a spraying tank with pesticide, and optionally also pressurizing the tank, by the attachment of puncture of a pressurized container of agrochemical, is disclosed in U.S. Pat. No. 3,993,245 to Colin P. Smith. Charging of tanks with gas by puncture of a container of gas is also involved in U.S. Pat. Nos. 3,361,298, 3,384,267, and 3,626,476.

SUMMARY OF THE INVENTION

In accordance with the present invention, a tank of a spray unit is charged with compressed air through an air filler check valve of the type having a non-puncturing depressible stem for opening the valve to admit pressurized air. The air is supplied from a suitable source having a check valve head for cooperation with the check valve of the spray unit to admit air through the valves to the tank of the spray unit. No puncturing of a separate container of gas is involved. A pressure relief valve and a pressure gauge are preferably provided along with the air filler check valve, and the valves and gauge are preferably affixed to a cylinder to provide an adapter which may be inserted between the tank and cap of the spray unit. The tank has a manual pump, so the air filler check valve provides an alternative means for pressurizing the tank.

Accordingly, it is an object of the invention to pressurize the tank of a spray unit either by manual pumping or by admission of air through a non-puncturing type of air filler check valve.

Another object of the invention is to provide the air filler check valve in an adapter which can be inserted between the top of the tank and a cap for the tank without requiring alternation of the spray unit.

A further object of the invention is to measure the pressure in the spray unit with a gauge and to release excess pressure from the unit with a pressure relief valve.

Other objects of this invention will appear from the following description and appended claims, reference being had to the accompanying drawings forming a part of this specification wherein like reference characters designate corresponding parts in the several views.

Figure 1:
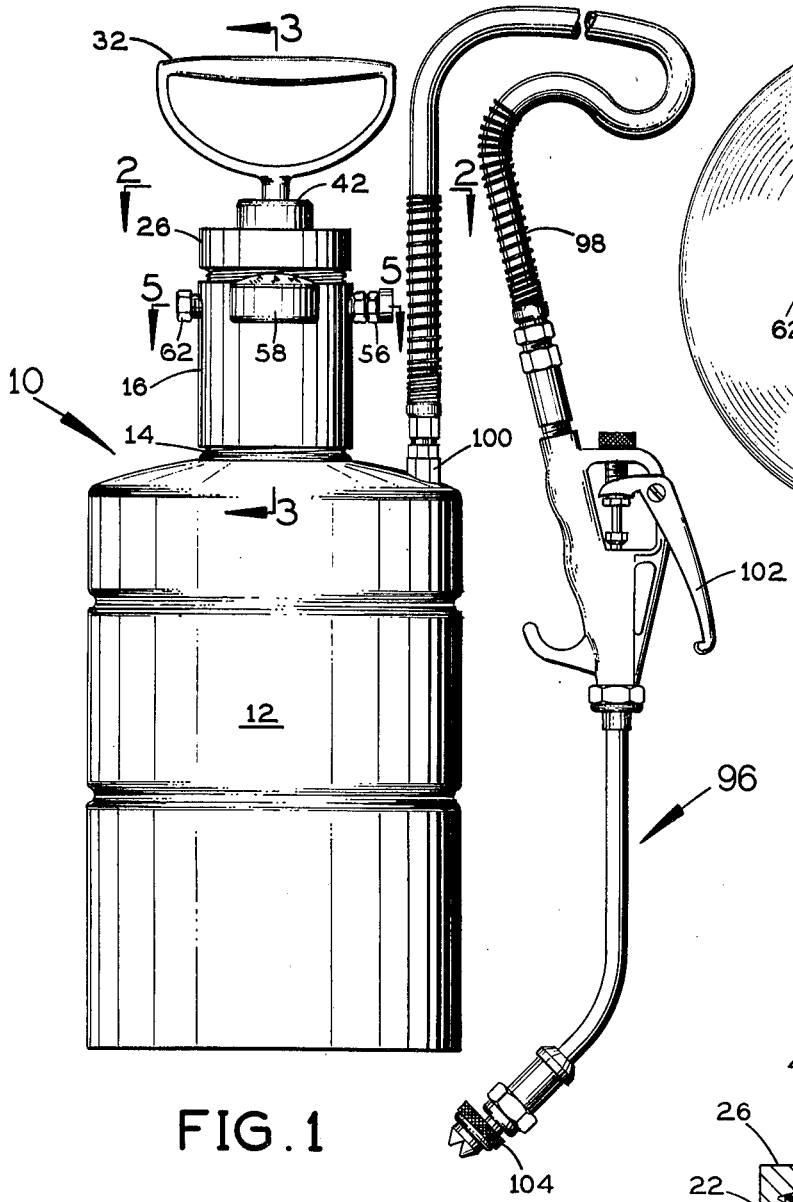
FIG. 1 is an elevational view of a spray unit provided with a tank pressurizing adapter in accordance with one embodiment of the invention.
Figure 2:
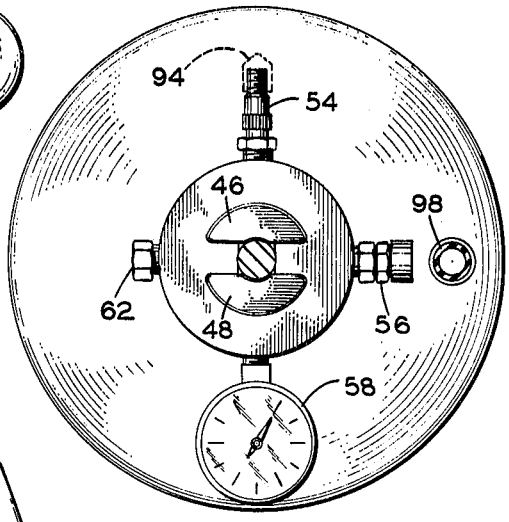
FIG. 2 is a cross-sectional view taken along line 2—2 of FIG. 1.
Figure 3:
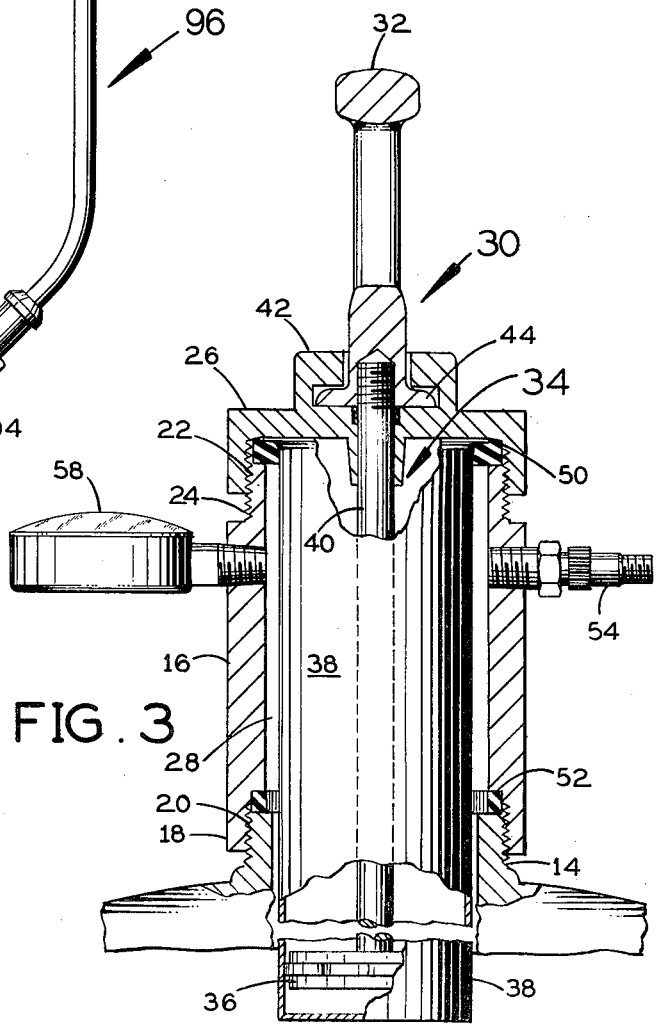
FIG. 3 is a vertical sectional view taken along line 3—3 of FIG. 1.
Figure 4:
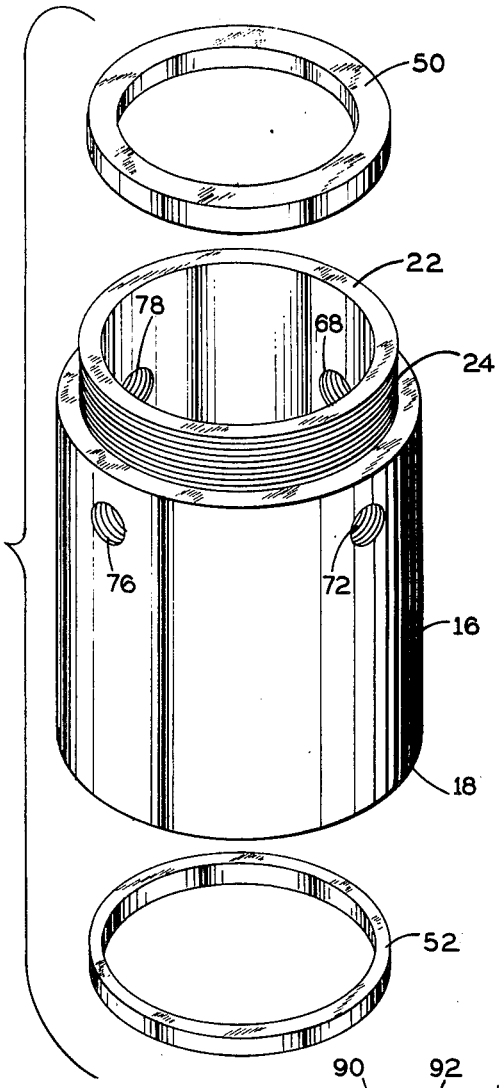
FIG. 4 is a perspective view of a cylinder included in the adapter together with sealing rings for the cylinder.
Figure 5:
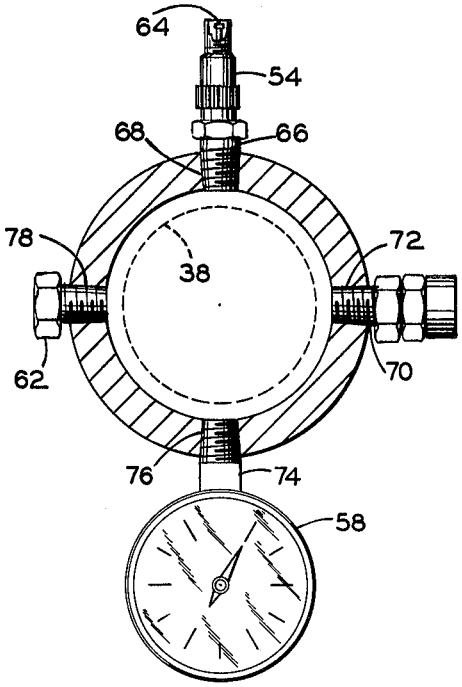
FIG. 5 is a cross-sectional view through the adapter taken along line 5—5 of FIG. 1.
Figure 6:
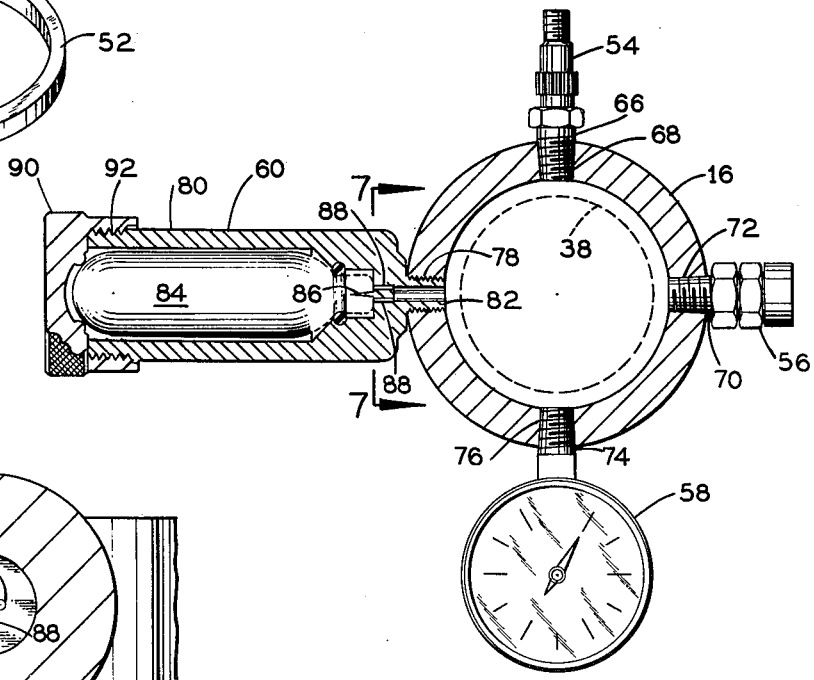
FIG. 6 is a sectional view similar to FIG. 5 but showing a gas cartridge charging valve added to the adapter.
Figure 7:
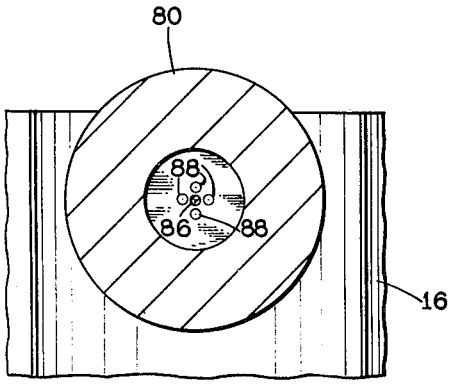
FIG. 7 is a sectional view taken along line 7—7 of FIG. 6.

Before explaining the disclosed embodiment of the present invention in detail, it is to be understood that the invention is not limited in its application to the details of the particular arrangements shown, since the invention is capable of other embodiments. Also, the terminology used herein is for the purpose of description and not of limitation.

DETAILED DESCRIPTION

The spray unit 10 includes a tank 12 for containing the pesticide liquid to be sprayed. The tank 12 has an externally threaded top 14 on which an adapter cylinder 16 is received. The adapter cylinder 16 has a bottom 18 which is internally threaded at 20 to screw onto the top 14 of the tank 12. The cylinder 16 has a top 22 which is externally threaded at 24 to receive a cap 26 which is internally threaded to match the external threads 24 on the cylinder. When the adapter 16 is not in place, the cap 26 can be screwed directly onto the threads at the top 14 of the tank 12.

The cylinder 16 may be inserted between the cap and the tank without modifying the spray unit in any way. The cylinder communicates through the space 28 with the interior of the tank. A spray unit 10 also includes a manually actuated pump 30 of which the cap 26 is a part. The pump 30 also includes an actuator or handle 32 and a piston and cylinder assembly 34 with a piston 36 and a cylinder 38 for pressurizing fluid in the tank by reciprocation of the actuator 32 and the piston 36. The piston 36 includes suitable valving (not shown) for pumping air into the tank 12.

The actuator 32 is connected to the piston 36 by a shaft 40. The cap 26 includes an undercut projection 42 which receives a flange 44 of the actuator 32. The actuator 32 may be rotated so that the flange 44 can escape from the projection 42 through the openings 46 and 48.

The manual pump 30 may be operated, if desired, to pressurize the tank 12 with pressurized air. However, it is not always convenient or expedient to pressurize the tank 12 by manual pumping, so the adapter 16 serves as an alternative for pressurizing the tank. The adapter cylinder 16 is provided with an upper sealing ring or gasket 50 and a lower sealing ring or gasket 52. In the assembled spray unit with adapter, the gasket 50 engages the cap 26 and the top 22 of the adapter 16. The sealing ring 52 engages the top 14 of the tank and the bottom 18 of adapter cylinder 16. The sealing rings 50 and 52 prevent escape of compressed air or other gas.

Affixed to the adapter cylinder 16 are an air filler one way check valve 54, a pressure relief valve 56, and a pressure gauge 58. Optionally, a gas cartridge charging device 60 may be affixed to the cylinder 16, but when the charging device 60 is not in use, the plug 62 is inserted in the cylinder to prevent escape of compressed air or other gas. The charging device 60, plug 62 and opening 78 are omitted in some embodiments.

The air filler check valve 54 provides the main alternative for pressurizing the tank 12 with the compressed air. The check valve 54 includes a non-puncturing depressible valve stem 64 for opening the valve 54 to admit pressurized air from the pressurized air source (not shown). The valve 54 has a threaded neck 66 which is screwed into a threaded opening 68 of the adapter cylinder 16. The valve 54 communicates with the interior of the cylinder and thus with the interior of the tank 12 so that compressed air introduced through the valve 54 is received by the tank.

The pressure relief valve 56 has a threaded neck 70 which screws into a threaded opening 72 of the adapter cylinder 16. The pressure relief valve also communicates with the interior of the cylinder and the tank for releasing excess pressure in the cylinder and tank above a threshold value. The pressure relief valve may be set to release air at a pressure of 150 psi.

The pressure gauge 58 has a threaded neck 74 which screws into a threaded opening 76 in the adapter cylinder 16. The pressure gauge 58 communicates with the interior of the cylinder and the tank for indicating the value of pressure in the cylinder and tank. The pressure gauge indicates values up to 160 psi in a particular embodiment.

In normal use, the plug 62 screws into a threaded opening 78 in the adapter cylinder 16 and merely prevents escape of gas. However, it is possible to replace the plug 62 with the gas cartridge device 60 which includes a charging valve of the puncturing type.

The gas cartridge charging device 60 includes a housing 80 with a threaded neck 82 which may be screwed into the opening 78 such that the interior of the housing communicates with the interior of the adapter cylinder 16. Inside the housing 80, there is a rupturable container 84 of compressed gas such as carbon dioxide. A needle 86 is affixed to the right end of the housing 60 for puncturing the container 84, and there are one or more openings 88 in the neck 82 of the housing for allowing gas from the container 84 to reach the interior of the cylinder 16. An internally threaded closure 90 engages the left end of the housing 80 at the threads 92. The closure 90 may be rotated to push the container 84 against the needle 86 for the purpose of puncturing the container to release the compressed carbon dioxide or other gas therein. The gas cartridge device 60 remains affixed to the cylinder until the gas pressure inside the cylinder is used or released.

Gas pressure may be released from the cylinder by depressing the valve stem 64 of the air filler check valve 54. The valve cap 94 may be utilized for this purpose.

The spray unit also includes a spray nozzle assembly 96 for spraying pressurized fluid from the tank 16. The spray nozzle assembly 96 includes a hose 98 that communicates the assembly 96 with the interior of the tank 12 through an outlet 100. The assembly 96 includes a spraying valve 102, and a nozzle 104.

Thus, the invention provides alternative devices for pressurizing the tank of a pesticide spraying unit. The tank may be pressurized manually by operating the pump 30. When more rapid pressurization is desired, the tank may be filled with compressed air through the air filler check valve 54 utilizing an air hose with a mating check valve for cooperation with the air filler check valve 54. Optionally, the tank may be filled with compressed carbon dioxide or other compressed gas utilizing the gas cartridge charging device 60. The adapter 16 can be provided as a separate item to be inserted between the tank and cap of the spray unit when needed. Alternatively, but presently less desirable, the adapter may be incorporated permanently into the spray unit.

Having thus described my invention, I claim:

1. A tank pressurizing adapter in combination with a spray unit including:

a tank for containing fluid to be sprayed, said tank having a threaded top;

a manually actuated pump for the tank having a threaded cap and an actuator and piston and cylinder assembly for pressurizing fluid in the tank, said actuator projecting above said cap and reciprocating in operation to operate said pump to pressurize air in the tank;

and a spray nozzle assembly communicating with said tank for spraying pressurized fluid from said tank;

said adapter providing an alternative means for pressurizing fluid in said tank and comprising:

an adapter cylinder having a threaded bottom screwed on to said threaded top of said tank and a threaded top screwed on to said threaded cap so as to position said adapter cylinder between said tank and said cap in communication with said tank;

said piston and cylinder assembly extending downward from said cap inside said adapter cylinder and spaced radially from the interior thereof;

and air filler check valve means affixed to the outside of said adapter cylinder and communicating with the interior space thereof outside said piston and cylinder assembly for introducing pressurized air into said adapter cylinder and said tank, thus providing an alternative to said pump for pressurizing said tank;

said air filler check valve means including a non-puncturing depressible stem for opening said valve means to admit pressurized air.

2. The adapter as claimed in claim 1 further including:

pressure relief valve means affixed to said adapter cylinder and communicating with the interior of said adapter cylinder for relief of excess pressure in said adapter cylinder above a threshold value.

3. The adapter as claimed in claim 2 further including:

pressure gauge means affixed to said adapter cylinder and communicating with the interior of said adapter cylinder for indicating the value of pressure in said adapter cylinder.

4. The adapter as claimed in claim 3 further including:

gas cartridge means affixed to said adapter cylinder and communicating with the interior of said adapter cylinder for pressurizing the interior of said adapter cylinder and said tank with pressurized gas supplied from said gas cartridge means, thus providing another alternative for pressurizing said tank in the operation of said adapter.

5. The adapter as claimed in claim 4 in which said gas cartridge means includes:

a housing affixed to said adapter cylinder and communicating with the interior thereof;

a rupturable container of pressurized gas in said housing;

a needle affixed to said housing for puncturing said container;

and a closure threadedly engaging said housing and operable to press said container against said needle to rupture said container.

6. The adapter as claimed in claim 5 in which:

said air filler valve means, said pressure relief valve means, said pressure gauge means and said gas cartridge means each have a threaded neck, and said adapter cylinder has threaded openings receiving said threaded necks respectively.

7. The adapter as claimed in claim 6 in which:

said needle of said gas cartridge means is located at said threaded neck thereof at one end of said housing; and said closure is located at the other end of said housing.

8. The adapter as claimed in claim 7 in which:

said threaded neck of said gas cartridge means has means forming at least one opening therein adjacent said needle for passing gas to the interior of said cylinder.

9. The adapter as claimed in claim 1 in which:

said air filler valve means is capable of allowing air release upon actuation thereof.

10. The adapter as claimed in claim 1 in which:

said adapter further includes sealing rings for cooperation with the threads at the top and bottom of said adapter cylinder.

11. A tank pressurizing adapter in combination with a spray unit including:

a tank for containing fluid to be sprayed, said tank having a threaded top;

a manually actuated pump for the tank having a threaded cap and an actuator and piston and cylinder assembly for pressurizing fluid in the tank, said actuator projecting above said cap and reciprocating in operation to operate said pump to pressurize air in the tank;

a spray nozzle assembly communicating with said tank for spraying pressurized fluid from said tank;

an adapter cylinder having a threaded bottom screwed on to said threaded top of said tank and a threaded top screwed on to said threaded cap so as to position said adapter cylinder between said tank and said cap in communication with said tank;

said piston and cylinder assembly extending downward from said cap inside said adapter cylinder and spaced radially from the interior thereof;

air filler check valve means affixed to said adapter cylinder and communicating with the interior space thereof for introducing pressurized air from a source thereof into said adapter cylinder and said tank, thus providing an alternative to said pump for pressurizing said tank;

said air filler check valve means having a nonpuncturing depressible stem for opening said valve means to admit pressurized air;

pressure relief valve means affixed to said adapter cylinder and communicating with the interior of said adapter cylinder for relief of excess pressure in said adapter cylinder above a threshold value;

and pressure gauge means affixed to said adapter cylinder and communicating with the interior of said adapter cylinder for indicating the value of pressure in said adapter cylinder.

12. An adapter as claimed in claim 11 in which:

said air filler valve means, said pressure relief valve means and said pressure gauge means each have a threaded neck, and said adapter cylinder has threaded openings receiving said threaded necks respectively.

13. The adapter as claimed in claim 11 in which:

said air filler valve means is capable of releasing pressure from said adapter cylinder upon actuation thereof.

14. The adapter as claimed in claim 13 in which:

said adapter further includes sealing rings for cooperation with the threads at the top and bottom of said adapter cylinder.

15. The adapter as claimed in claim 11 in which:

said tank top is externally threaded, said cap is internally threaded, said adapter cylinder top is externally threaded, and said adapter cylinder bottom is internally threaded.

* * * * *